US008858258B2

(12) United States Patent
Stokowski et al.

(10) Patent No.: US 8,858,258 B2
(45) Date of Patent: Oct. 14, 2014

(54) TWO-PART CONTACT ELEMENT FOR HIGH-VOLTAGE PLUG-AND-SOCKET CONNECTOR

(75) Inventors: Alexander Stokowski, Oetisheim (DE); Christoph Kosmalski, Darmstadt (DE); Rolf Jetter, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 7 days.

(21) Appl. No.: 13/499,193

(22) PCT Filed: Sep. 23, 2010

(86) PCT No.: PCT/EP2010/064041

§ 371 (c)(1),
(2), (4) Date: Mar. 29, 2012

(87) PCT Pub. No.: WO2011/039099

PCT Pub. Date: Apr. 7, 2011

(65) Prior Publication Data

US 2012/0184122 A1 Jul. 19, 2012

(30) Foreign Application Priority Data

Sep. 30, 2009 (DE) ..... 10 2009 043 516

(51) Int. Cl.

| | |
|---|---|
| ***H01R 9/05*** | (2006.01) |
| ***H01R 43/20*** | (2006.01) |
| ***H01R 13/42*** | (2006.01) |
| ***H01R 13/533*** | (2006.01) |
| *H01R 13/648* | (2006.01) |

(52) U.S. Cl.

CPC ..... *H01R 13/533* (2013.01); *H01R 43/20* (2013.01); *H01R 2201/26* (2013.01); *H01R 13/42* (2013.01); *H01R 13/648* (2013.01)

USPC ..... 439/582; 439/709

(58) Field of Classification Search

USPC ..... 439/578–585, 346, 723, 724, 721, 708, 439/709, 848

See application file for complete search history.

(56) References Cited

U.S. PATENT DOCUMENTS 2,203,973 A * 6/1940 Walls ..... 439/848

(Continued)

FOREIGN PATENT DOCUMENTS

DE 3727199 C1 12/1988

(Continued)

OTHER PUBLICATIONS

International Search Report and Written Opinion issued by the European Patent Office, dated Dec. 20, 2010, for related International Application No. PCT/EP2010/064041; 12 pages.

*Primary Examiner* — Ross Gushi

(74) *Attorney, Agent, or Firm* — Faegre Baker Daniels LLP

(57) ABSTRACT

The invention relates to a plug element (2) for a sealed high-voltage plug-and-socket connector (1), by means of which, in particular in an automobile, an electrical conductor (11) can be connected in electrically conductive manner to a mating contact element (46) of a mating plug element (3), with a housing body (7) which has a plug section (4) which can be fitted together with the mating plug element (3) in a direction of insertion (S) and a conductor receptacle section (6) remote from the plug section (4) with at least one conductor entry opening (10), and with at least one contact element (33) which has an insertion member (35) which is arranged spaced apart from the at least one conductor entry opening (10) in the plug section (4) and can be fitted together with the mating contact element (46), and a conductor fastening section (36) for connecting the at least one electrical conductor (11). Furthermore, the invention relates to a conductor end piece (26) for fastening an end section (55) of the electrical conductor (11) in the plug-and-socket connector (1) and also a modular system for the plug element (2), and to a method for assembling the plug element (2). In order to make the assembly of the plug element (2) simpler and more reliable, provision is made according to the invention for the conductor fastening section (36) to be designed as a plug contact (37) which is flush with the at least one conductor entry opening (10) in a direction of introduction (E) for the at least one electrical conductor (11) and for a conductor latching element (57, 57') to be arranged in the housing body (7), which element in a projection in the direction of introduction (E) overlaps the at least one conductor entry opening (10) at least in sections.

6 Claims, 6 Drawing Sheets

(56) References Cited

U.S. PATENT DOCUMENTS

| | | | | | |
|---|---|---|---|---|---|
| 3,107,133 | A | * | 10/1963 | Smith | 439/282 |
| 3,397,384 | A | * | 8/1968 | Lawrence | 439/246 |
| 3,456,231 | A | * | 7/1969 | Zimmerman, Jr. et al. | 439/532 |
| 3,697,935 | A | * | 10/1972 | Drapkin | 439/744 |
| 3,714,618 | A | * | 1/1973 | Appleton | 439/718 |
| 3,716,817 | A | * | 2/1973 | Wolfe et al. | 439/346 |
| 3,867,001 | A | * | 2/1975 | Hedman | 439/125 |
| 4,401,359 | A | * | 8/1983 | Frelk | 439/846 |
| 5,399,103 | A | | 3/1995 | Kuboshima et al. | |
| 6,287,144 | B1 | * | 9/2001 | Baffert | 439/578 |
| 6,461,184 | B2 | * | 10/2002 | Nimura | 439/352 |
| 6,860,761 | B2 | * | 3/2005 | Lee et al. | 439/582 |
| 6,875,040 | B1 | * | 4/2005 | O'Keefe et al. | 439/346 |
| 6,953,371 | B2 | * | 10/2005 | Baker et al. | 439/700 |
| 7,195,524 | B1 | * | 3/2007 | Lin | 439/851 |
| 7,413,455 | B2 | * | 8/2008 | Hughes et al. | 439/187 |
| 7,530,841 | B2 | * | 5/2009 | Henningsen | 439/578 |
| 7,753,725 | B2 | * | 7/2010 | Henningsen | 439/578 |
| 7,798,838 | B2 | * | 9/2010 | Grieff et al. | 439/346 |
| 8,628,352 | B2 | * | 1/2014 | Nugent | 439/578 |
| 2003/0224658 | A1 | * | 12/2003 | Koch et al. | 439/582 |
| 2004/0137790 | A1 | * | 7/2004 | Lee et al. | 439/582 |
| 2009/0017678 | A1 | * | 1/2009 | Meier et al. | 439/582 |
| 2009/0186522 | A1 | * | 7/2009 | Henningsen | 439/582 |

FOREIGN PATENT DOCUMENTS

| | | | |
|---|---|---|---|
| DE | 3732520 | A1 | 4/1989 |
| DE | 4404909 | A1 | 8/1994 |
| EP | 1883135 | A1 | 1/2008 |

* cited by examiner

TWO-PART CONTACT ELEMENT FOR HIGH-VOLTAGE PLUG-AND-SOCKET CONNECTOR

The present invention relates to a plug element for a sealed high-voltage plug-and-socket connector, by means of which, in particular in an automobile, at least one electrical conductor can be connected in electrically conductive manner to a mating contact element of a mating plug element, with a housing body which has a plug section which can be fitted together with the mating plug element in a direction of insertion and a conductor receptacle section remote from the plug section with at least one conductor entry opening, and with at least one contact element which has an insertion member which is arranged spaced apart from the conductor entry opening in the plug section and can be fitted together with the mating contact element, and a conductor fastening section for connecting the at least one electrical conductor.

Furthermore, the invention relates to a conductor end piece for fastening an end section of an electrical conductor in a plug-and-socket connector, with a conductor receptacle extending in a direction of introduction of the conductor end piece and a contact section which extends away from the conductor receptacle in the direction of introduction.

Further, the invention relates to a modular system for a plug element of a sealed high-voltage plug-and-socket connector, by means of which at least one electrical conductor can be connected to a mating contact element of a mating plug of the high-voltage plug-and-socket connector, with a housing body and at least one contact element which can be inserted in the housing body, which element has an insertion member which can be fitted together with the mating contact element and a conductor fastening section for connecting the at least one electrical conductor.

Finally, the invention relates to a method for the assembly of an electrical plug element, in particular for a sealed high-voltage plug-and-socket connector in an automobile, with at least one contact element for contacting a mating contact element of a mating plug element of the high-voltage plug-and-socket connector being arranged in a housing body of the plug element and the housing body being preassembled ready for insertion from a plurality of housing elements.

Plug elements for sealed high-voltage plug-and-socket connectors are known. The plug-and-socket connectors are used in particular in electrically-powered vehicles to connect high-voltage/high-current batteries to an onboard network of the vehicles. The entire vehicle can be supplied with power via the plug-and-socket connectors, and they therefore have to be very robust and reliable.

The plug-and-socket connectors are often used in harsh ambient conditions, since they are usually exposed to vibrations, moisture, dirt, dust and possibly chemically aggressive substances in vehicles. If aggressive, corrosive or electrically conductive substances were to enter a contact region between the contact elements, the result might be an interruption in the power supply or a short-circuit between the contact elements. In order to protect the contact elements of the plug-and-socket connector from harmful environmental influences, the plug-and-socket connectors are usually designed sealed. An inner space of the plug-and-socket connectors is protected at least against road spray. Preferably the inner space is sealed off completely against the penetration of water and particles, and most preferably is protected from environmental influences in gastight manner.

Furthermore, the plug-and-socket connectors and/or the contact elements located therein are usually electrically shielded. Thus, a direct current (DC) provided by the battery is often converted, in a converter integrated in the battery or arranged directly thereon, into alternating current (AC) which is used to supply the electric drive motors of the vehicle and can flow both to the battery and away therefrom. Since the alternating current can generate electrical interference fields and thus can adversely affect the operation of neighbouring electrical components, shielding for the contact elements and electrical conductors is necessary. The shielding intercepts the electromagnetic interference fields and guides them to an earth potential, where they can safely be conducted away without causing any damage. The shielding should surround the electrical conductors and the contact elements completely and in operation be connected uninterruptedly to the earth potential in order to ensure safe conducting-away of electrical interference fields.

An electrical plug-and-socket connector in accordance with the prior art is described for example in European patent application EP 1883135 A1. In this plug-and-socket connector, stripped ends of the electrical conductor are connected to the contact element associated therewith in each case by means of a crimp connection. The electrical conductors which are thus made up beforehand are then, together with the contact elements, inserted individually into fastening elements and surrounded by screen elements, in order then to be guided through a housing cover and fixed jointly with the housing cover in a casing body of the housing body.

This procedure in the case of known plug-and-socket connectors results in the disadvantage that an assembler has to keep the plug-and-socket connector stocked as its individual parts and has to assemble it correctly. In the case of a complex plug-and-socket connector with high safety and quality requirements as in the present case, there is thus for example the risk that the electrical conductors and the contact elements will not be connected together reliably or will not be inserted correctly in the housing, and thus may cause faults. In order to avoid this, the assembler must be trained anew for each new generation of plug-and-socket connectors. A manufacturer of the plug-and-socket connectors must provide reliable training documents or extensive assembly documents or offer training, and can intervene in the assembly process only with difficulty in order to ensure correct assembly.

Consequently, it is an object of the invention to make the assembly of a generic plug-and-socket connector simpler and more reliable.

In a plug element according to the invention, this object is achieved in that the conductor fastening section is designed as a plug contact which is flush with the conductor passage opening in a direction of introduction for the at least one electrical conductor and a conductor latching element is arranged in the housing body, which element in a projection in the direction of introduction overlaps the at least one conductor entry opening at least in sections.

This solution has the advantage that the plug element can be preassembled at the manufacturer's or at a fabricator's, and it only remains for the assembler to make up the electrical conductor or a cable and introduce it through the conductor passage openings into the plug element, the electrical conductor being automatically latched in the housing body. Thus the individual parts of the plug-and-socket connector which have to be stocked at the assembler's, and also the working steps necessary up to final assembly of the plug-and-socket connector and consequently any sources of error in the assembly process, are reduced. Further, the solution has the advantage that the connection between the electrical conductor and the contact element can be designed to be able to be produced and detached simply and repeatedly, which in particular facilitates repairs to the electrical conductor and/or the plug-and-socket connector.

For a generic plug element, the solution according to the invention can be combined as desired and improved further with the following configurations which are each advantageous per se.

Thus, according to a first possible advantageous configuration of a plug element according to the invention, provision may be made for the direction of insertion to extend approximately at right-angles to the direction of introduction. Thus the plug-and-socket connector can be made as flat as possible in the direction of insertion, which contributes to reducing installation space. On a side of the plug-and-socket connector which lies opposite a connection face of the plug-and-socket connector which points in the direction of insertion there may be formed a pressure surface on which an insertion force necessary for inserting the plug element can be introduced into the plug element and the plug-and-socket connector can thus reliably be transferred into a final assembly position.

According to another advantageous configuration of a plug element according to the invention, provision may be made for the housing body to comprise a closure piece in which the at least one conductor entry opening is arranged and which is fitted together with a casing element of the housing body in the direction of introduction. Thus the closure piece may be placed on an opening into a conductor receptacle space of the plug-and-socket connector, for example in the form of a closing cap, and engage around the housing element. The housing body can thus be formed merely from the casing element and the closure piece. This helps minimise the number of housing components and also the closure regions to be sealed off which are formed therebetween. The conductor receptacle section with the conductor receptacle space and also the plug section can be formed on the casing element. For this, the casing element can be formed in one piece, which improves in particular the stability of and ability to seal off the plug-and-socket connector.

According to a further advantageous configuration of a plug element according to the invention, the connection of the electrical conductor to the contact element can be made simpler in particular in that the conductor fastening section is designed as a pin receptacle. An end of the electrical conductor which is to be electrically contacted can thus be designed as a pin contact and simply inserted into the pin receptacle on the contact element.

In order to improve the electrical contact between the electrical conductor and the pin receptacle and to reduce line resistances between the electrical conductor and the pin receptacle, according to a further advantageous configuration of a plug element according to the invention provision may be made for a spring sleeve to be arranged in the pin receptacle, the spring force of which sleeve acts transversely to the direction of introduction. The electrical conductor, in a fastening position in which it is connected to the contact element, is held fast in the pin receptacle at its pin contact by the spring sleeve and is securely electrically contacted. The spring force of the spring sleeve in this case helps in particular to compensate for vibrational forces acting on the plug-in connection between the electrical conductor and the conductor fastening section and thus to avoid interruptions in contact due to vibration.

For simply contacting a shielding of the electrical conductor, in a plug element according to the invention according to a further advantageous configuration provision may be made for a screen contact element to project in the housing body, transversely to the direction of introduction, into a conductor receptacle space extending along the direction of introduction. The screen contact element can simply contact the screen arranged on the electrical conductor by overlapping the conductor entry opening at least in sections in the direction of introduction and transversely to the direction of introduction contacting a spring force on the screen introduced into the housing body and lying externally on the conductor or the insulation thereof. Alternatively, a contact region of the shielding of the conductor can be compressed on passing through the conductor entry opening transversely to the direction of introduction and expanded in the conductor receptacle space in order to contact the screen contact element.

The conductor end piece referred to first hereinbefore is known from the prior art for example in the form of a wire end ferrule, which in accordance with the specifications of the German Verband der Elektronik, Elektrotechnik and Informationstechnik e.V. (VDE—Association for Electrical, Electronic & Information Technologies) has to be applied to electric lines which consist of individual strands. Such wire end ferrules are pushed on to the stripped strands of the electrical conductor or cable, pressed with pliers transversely to the direction of introduction and are thus connected to the electrical conductor in a non-positive and/or positive manner. Usually, the conductor end ferrules comprise a metal sleeve which finishes off flush with the end of the conductor and a protective collar of plastics material pointing in the direction of an insulation of the conductor counter to the direction of introduction. The pressed metal part of the sleeve, in accordance with the prior art, is usually fastened in clamps by a screw in a conductor fastening section of known plug-and-socket connectors or other electrical connection members and pressed against an electrical contact surface.

With the conductor end piece referred to first hereinbefore, the object formulated above is achieved according to the invention in that a latching member extends along an outer periphery of the conductor end piece. The latching member can simply be introduced through the conductor entry opening on the plug element and pushed in the direction of introduction as far as the level of the conductor latching element which cooperates with the latching member. The conductor latching element cooperates with the latching member and secures the conductor end piece in the conductor receptacle space, so that movements of the electrical conductor and of the conductor end piece in and/or transversely to the direction of introduction are prevented. Since the latching member extends along the outer periphery of the conductor end piece and can thus surround it in annular manner, the solution according to the invention makes it possible to fasten the electrical conductor in the plug-and-socket connector without specifying a rotary position about a central conductor axis pointing in the direction of introduction. Furthermore, the peripheral arrangement of the latching member on the conductor end piece means that rotary movements of the electrical conductor in the fastening position can be permitted and thus torsional forces in the electrical conductor can be reduced; these inevitably occur when the plug element together with the connected electrical conductor is mounted with rotary movements about the central conductor axis.

A conductor end piece according to the invention can be combined as desired and improved with the following further possible configurations.

Thus according to a first possible configuration of a conductor end piece according to the invention the insertion of the conductor end piece into the conductor fastening section of the contact element in the plug element which is designed as a plug contact in particular is simplified in that the contact section is designed as a pin contact.

Fastening of the electrical conductor to the conductor end piece and the locking of the conductor end piece in the plug element, according to a further possible configuration of a conductor end piece according to the invention, is simplified in that the conductor receptacle is formed in a cylindrical sleeve section of the conductor end piece and the fastening member is designed as an engagement groove extending along the outer periphery of the sleeve section. A stripped end section of the electrical conductor can simply be pressed into the cylindrical sleeve section in the direction of introduction. The conductor latching element in the conductor receptacle space of the plug-and-socket connector may be designed as a latch projection which engages in the engagement groove in the fastening position.

According to a further advantageous configuration of a conductor end piece according to the invention, provision may be made for the conductor end piece to be formed as a one-piece metal part. As a one-piece metal part, the conductor end piece is simple to manufacture. The conductor receptacle and the contact section are connected tightly together. The latching member, in a conductor end piece formed as a one-piece metal part, is low-wear and stable.

In the modular system referred to first hereinbefore, the object formulated above is achieved according to the invention in that the conductor fastening section is designed as a plug contact and in that a conductor latching element and a conductor end piece which is designed to be able to be fitted together with the plug contact and can be attached to a free end of the at least one electrical conductor to be arranged in the housing body is provided with a latching member which cooperates with the conductor latching element. This solution has the advantage that the contact element can be inserted into the housing body at the manufacturer's or fabricator's and this can be delivered to the assembler in a preassembly position in which the housing elements are latched together. On the part of the assembler, the conductor end piece merely needs to be attached to the free end of the electrical conductor, introduced into the housing body and locked there on the conductor latching element. Then the plug element can be assembled with the mating plug element and the plug-in connection is produced.

In the method referred to first hereinbefore, the object formulated above is achieved according to the invention in that after the preassembly of the housing body at least one electrical connecting line is inserted into a conductor receptacle opening in the housing body, is latched and is simultaneously connected in electrically conductive manner to the at least one contact element. As has already been discussed above, analogously to the solutions according to the invention with the plug element, conductor end piece and modular system, this reduces and simplifies the working steps to be carried out at the assembler's. The plug element or the housing body thereof can be preassembled at the manufacturer's or fabricator's and delivered ready for insertion, so that the components of the plug element or of the housing body can be connected undetachably together when they arrive with a user.

The invention will be explained in greater detail below by way of example using advantageous embodiments with reference to the appended drawings. The embodiments described here merely represent possible configurations in which however the individual features, as described above, can be realised and omitted independently of each other. In the description of the figures, for simplicity the same features and elements are provided with the same reference numerals, in order to avoid repetition and to observe consistency of the reference numerals used.

Figure 1:
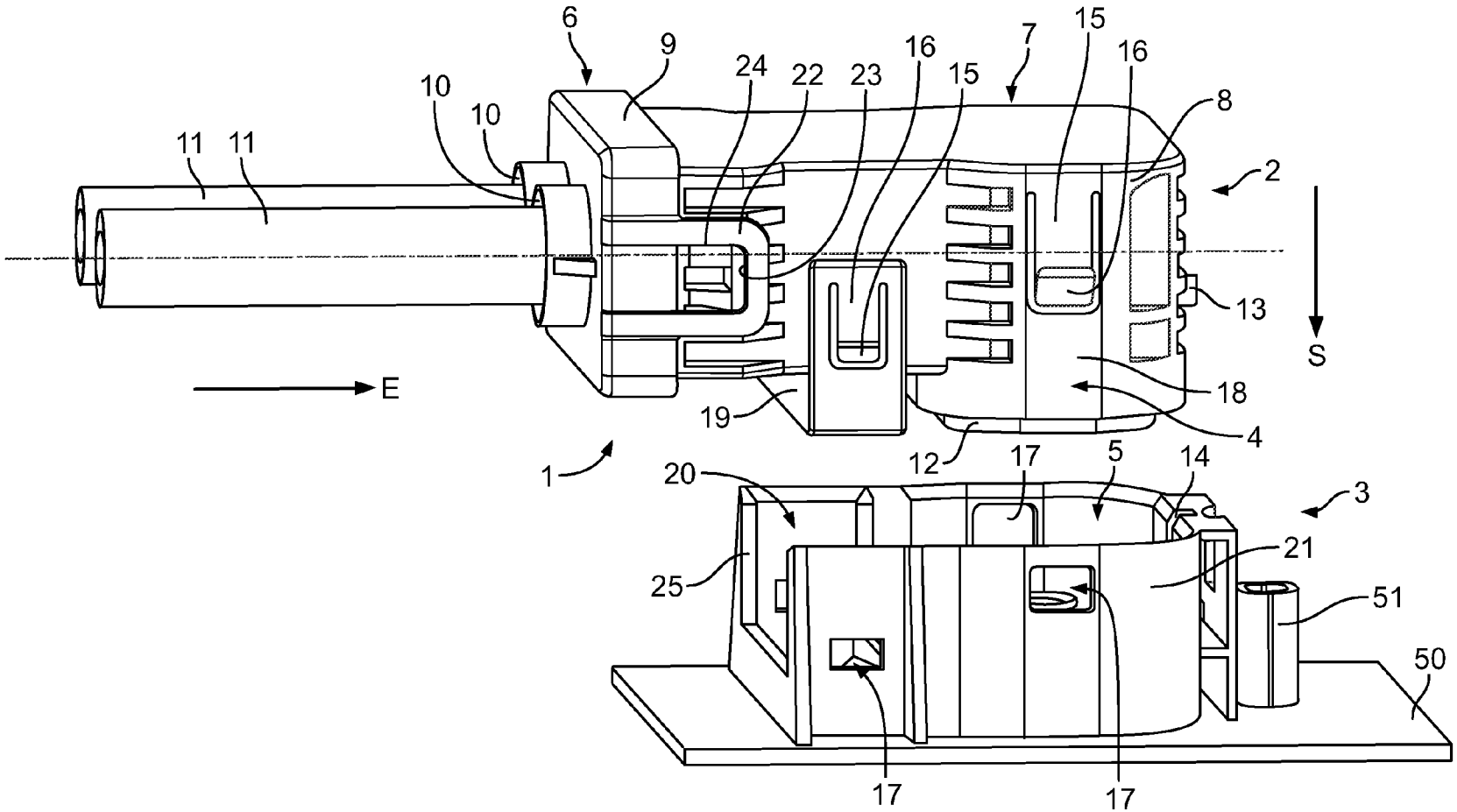
FIG. 1 shows a diagrammatic perspective view of a plug element according to the invention into which electrical conductors are inserted and which is arranged so it can be fitted together with a mating plug element.

First of all, a plug-and-socket connector 1 according to the invention will be described with reference to FIG. 1, which shows the plug-and-socket connector 1 in a preassembly position V. In the preassembly position V, all the elements of a plug element 2 of the plug-and-socket connector 1 are assembled and latched. The plug element 2 is ready to be fitted together with a mating plug element 3 of the plug-and-socket connector 1 in a direction of insertion S of the plug element 2. In the arrangement shown in FIG. 1, the plug element 2 is arranged above the mating plug element 3 such that a plug section 4 of the plug element 2 can be introduced into a base-like plug receptacle 5 of the mating plug element 3.

A conductor receptacle section 6 of the plug element 2 is arranged on a side of the plug element 2 remote from the plug section 4. The plug section 4 and the conductor receptacle section 6 are formed on a housing body 7 of the plug element 2. The housing body 7 comprises a casing element 8 and a closure piece 9 placed on the casing element.

Two conductor entry openings 10 are formed in the closure piece 9. One electrical conductor 11 in each case is introduced into the conductor entry openings 10 in a direction of introduction E of the electrical conductor 11 into the plug element 2 through a wall of the housing body 7.

Furthermore, a sealing element 12 projects from the plug section 4 of the plug element 2 in the direction of insertion S in order to seal off the plug element 2 from the plug receptacle 5 when the plug section is fitted together with the mating plug element 3 up to a final assembly position F.

A guide element 13 on the plug element 2 is designed to cooperate with a guide 14 on the mating plug element 3. The guide 14 is designed as a guide groove in the plug receptacle 5 which extends in the direction of insertion S. The guide element 13 designed as a nipple-shaped projection engages in the guide 14 on introducing the plug section into the plug receptacle 5.

Upon reaching the final assembly position F, latch projections 16 formed on latch tabs 15 of the plug element 2 engage in latch openings 17 on the mating plug element 3 and lock the plug element 2 in the mating plug element 3. The latch tabs 15 with the latch projections 16 are formed partly in an outer wall 18 on the plug section 4 of the plug element 2 and partly on a supporting member of the plug element 2 which projects from the plug element 2 in the direction of insertion S. The supporting member 19 in the final assembly position F engages in a supporting receptacle 20 on the mating plug element 3, in which receptacle some of the latch openings 17 are formed. Further latch openings 17 are formed in a wall 21 of the plug receptacle 5 of the mating contact element 3.

Further, latch tabs 22 which form latch openings 23 are formed on the closure piece 9. Latch projections 24 on the housing body 7 of the plug element 2 engage in the latch openings 23 and lock the closure piece 9 on the conductor receptacle section 6. For a structural form of the plug-and-socket connector 1 which is as flat as possible in the direction of insertion S, the conductor receptacle section 6 in the final assembly position F is received at least partially in a cutout 25 on the mating plug element 3. The cutout 25 is formed in the supporting receptacle 20.

Figure 2:
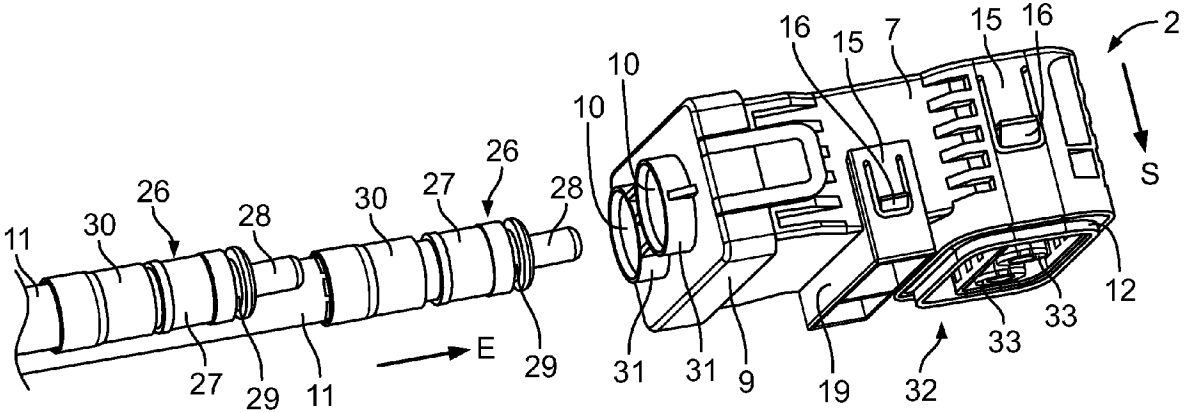
FIG. 2 shows a diagrammatic perspective view of a plug element according to the invention in the preassembly position and two electrical conductor chambers which are positioned so that they can be introduced into the plug element.

FIG. 2 shows the plug element 2 and two electrical conductors 11 in a diagrammatic perspective view. The housing body 7 of the plug element 2 is in a preassembly position $V_G$, in which the closure piece 9 on the casing element 8 and/or the components of the plug element 2 arranged in the housing body 7 are fitted together and/or latched in an end latching position. The electrical conductors 11 are in a preassembly position $V_L$ of the electrical conductors in which in each case a conductor end piece 26 is provided on a stripped free end of the respective electrical conductor 11.

The conductor end piece 26 has a conductor receptacle 27 designed as a cylindrical sleeve section, from which a pin-shaped contact section 28 extends away in the direction of introduction E. A latching member 29 of the conductor end piece 26 in the form of a groove extends along an outer periphery of the conductor receptacle 27.

Furthermore, the electrical conductors 11 are each provided with a screen contact sleeve 30, which is spaced apart, electrically isolated, from the conductor end piece 26 and contacts shielding of the electrical conductor 11. A collar 31 around the conductor entry opening 10 on the housing body 7 supports the electrical conductor 11 as soon as it is inserted into the plug element 2.

Further, a connection face 32 of the plug element 2 is shown in FIG. 2. Two contact elements 33 of the plug element 2, each associated with one of the electrical conductors 11, are arranged in the connection face 32. The contact elements 33 are surrounded by a sleeve-shaped plug-section shielding 34.

Figure 3:
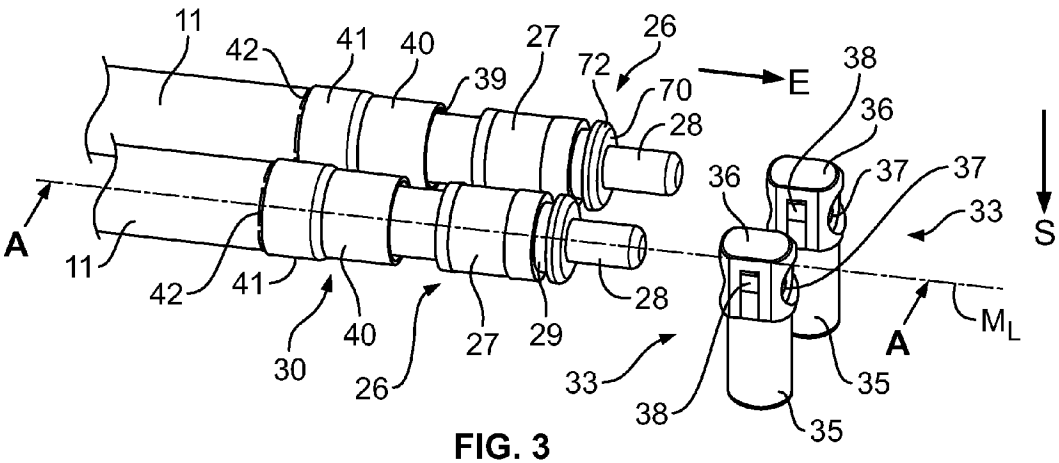
FIG. 3 shows two electrical conductors each provided with a conductor end piece according to the invention, which are positioned so that they can be fitted together with plug contacts.

FIG. 3 shows the contact elements 33 and the electrical conductors 11 in a diagrammatic perspective view. The contact elements 33 each have an insertion member 35 for fitting together with a mating contact element of the mating plug element 3, and a conductor fastening section 36 for the electrically contacting fastening of the electrical conductor 11. The conductor fastening sections 36 are each provided with a plug contact 37 designed as a pin receptacle for the contact sections 28 of the electrical conductors 11. The contact sections 28 of the electrical conductors 11 which are designed as contact pins may each be inserted in the direction of introduction E into the pin receptacles 37 of the contact elements 33. Furthermore, the contact elements 33 are each provided with fastening aids 38, which are designed to cooperate with fastening members of the plug elements 2 in order to lock the contact elements 33.

Further, FIG. 3 shows a respective conductor screen 39 of the electrical conductors 11 which is surrounded and electrically contacted by a screen contact section 40 of the screen contact sleeves 30. From the screen contact section 40, an insulation receptacle section 41 of the screen contact sleeves is shouldered counter to the direction of introduction E and engages with clamping elements 42 around an insulation of the respective electrical conductor 11.

Figure 4:
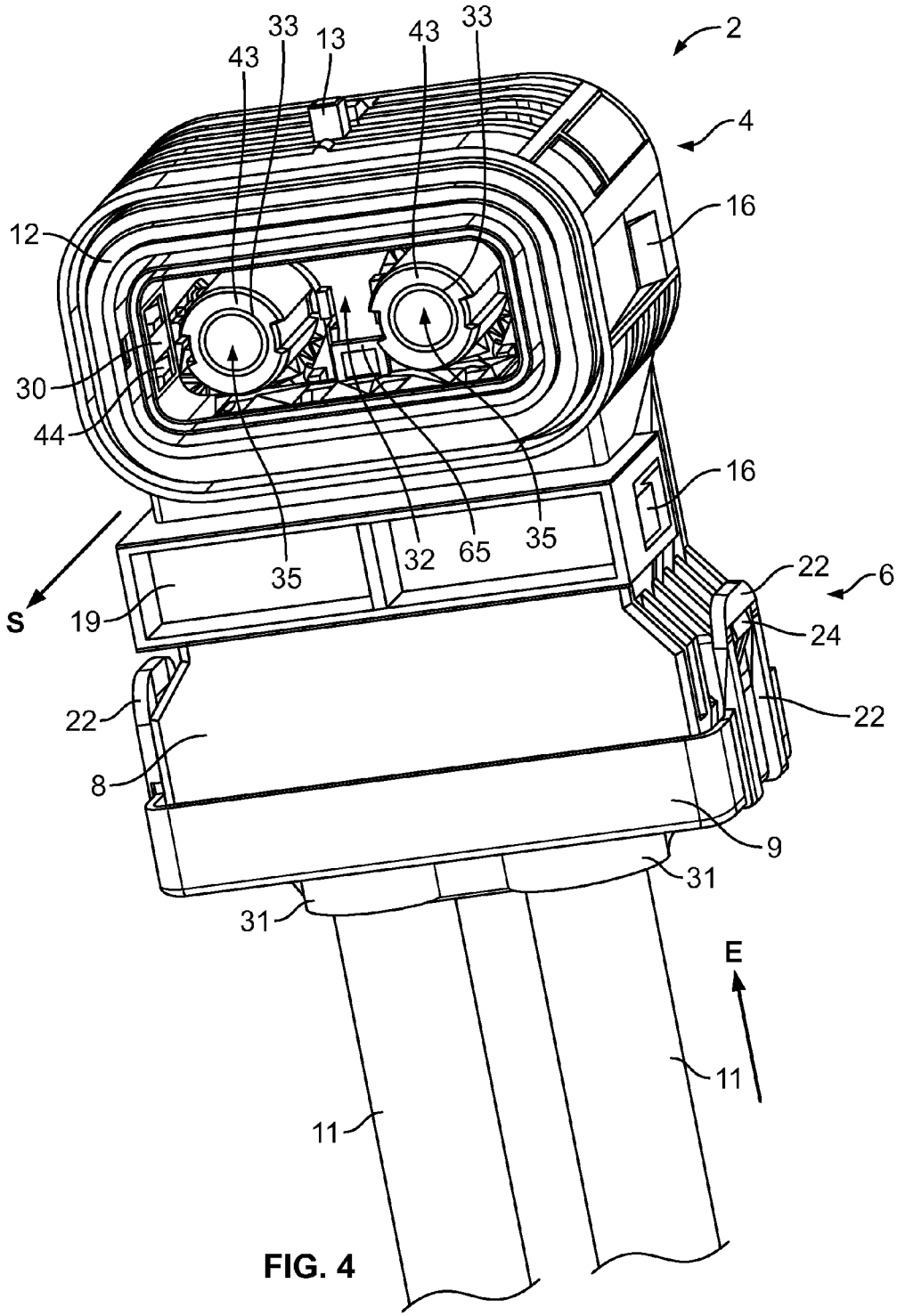
FIG. 4 shows a diagrammatic perspective view of a plug element according to the invention into which two electrical conductors are introduced.

FIG. 4 shows the plug element 2 in the preassembly position V with inserted electrical conductors 11 in a diagrammatic perspective view. In the view shown in FIG. 4, in particular a view of the connection face 32 of the plug element 2 is provided. It is obvious that the insertion members 35 are formed as contact-pin receptacles in the shape of cylindrical sleeves for mating contact elements of the mating plug element 3. The insertion members 35 are enclosed in contact-element holders 43 of the plug element 2. The contact-element holders 43 support the contact elements 33 transversely to the direction of insertion S and are of cylindrical form.

Around the contact elements 33 there is arranged the screen contact sleeve 30, which is provided with screen sleeve spring elements 44 which project, transversely to the direction of insertion S, into a receptacle formed in the plug face 32 for a mating screen contact sleeve 30 of the mating plug element 3, in order to contact it in a manner which is electrically conductive and as resistant to vibrations as possible.

Figure 5:
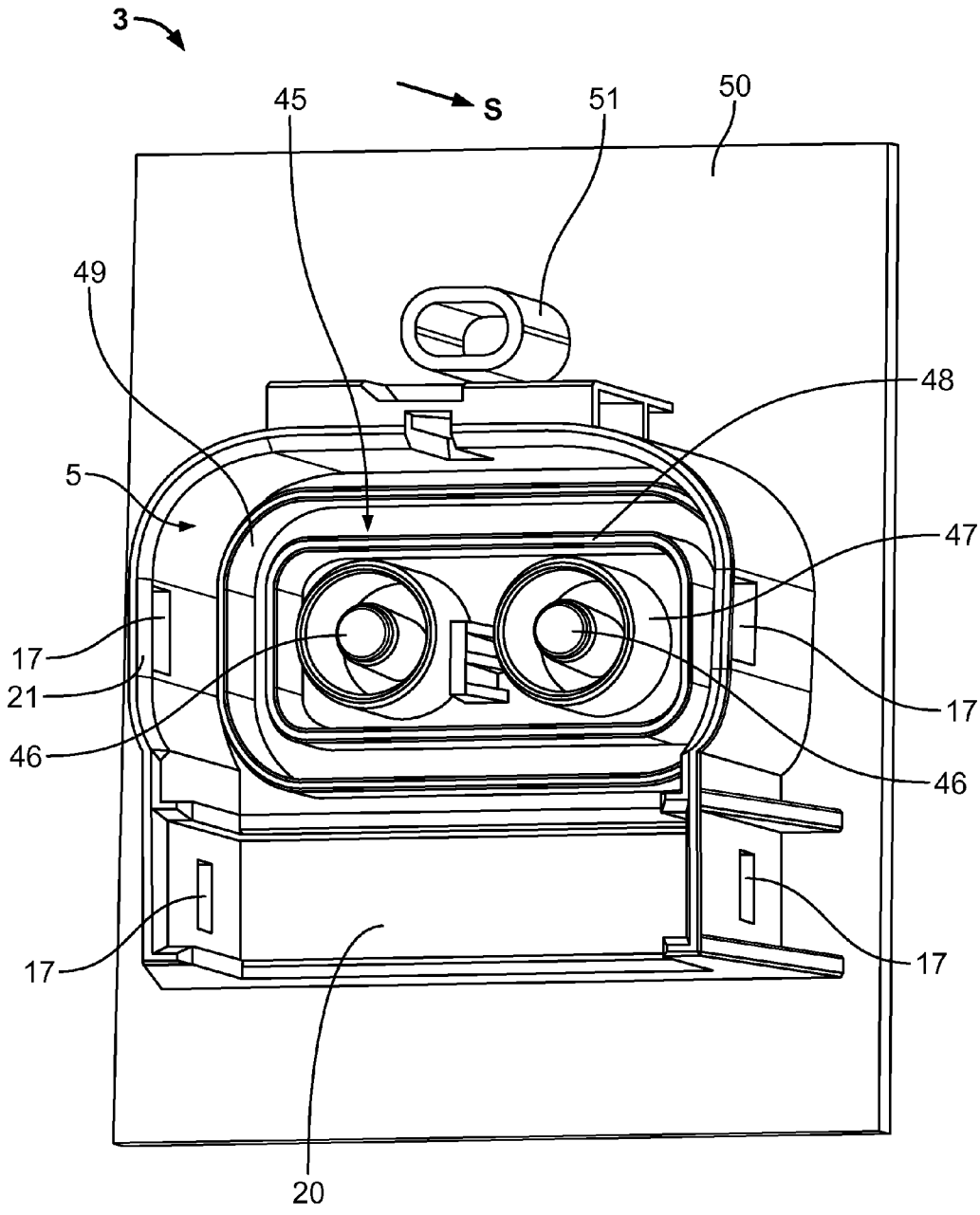
FIG. 5 shows a diagrammatic perspective view of a mating plug element.

FIG. 5 shows the mating plug 3 in a diagrammatic perspective view in which in particular a mating connection face 45 of the mating plug element 3 arranged in the plug receptacle 5 can be seen. The mating connection face 45 comprises two electrical mating contact elements 46 for electrically contacting the contact elements 33 of the plug element 2. The mating contact elements 46 are designed as contact pins which can in each case be introduced into the insertion members 35 of the contact elements 33 in the direction of insertion S. The mating contact elements 46 are surrounded by a supporting collar 47 which extends in the direction of insertion S and is designed to surround the contact-element holders 43 of the plug element 2.

A mating screen contact sleeve 48 surrounds the mating contact elements 46 and is designed to be surrounded in the final assembly position F by the screen contact sleeve 30 of the plug element 2.

A mating sealing element 49 projects into the plug receptacle 5 counter to the direction of insertion S, in order in the final assembly position F to press against the sealing element 12 on the plug element 2 transversely to the direction of insertion S and to surround said element. The mating sealing element 49 is rigid in the embodiment illustrated and the sealing element 12 is formed as a flexible strip seal.

Further, an assembly aid 51 in the form of a lead-through is formed on a mounting plate 50 to which the mating plug element 3 is fastened, with the aid of which the mating plug element 3 can be mounted or for example fastened on a battery housing.

Figure 6:
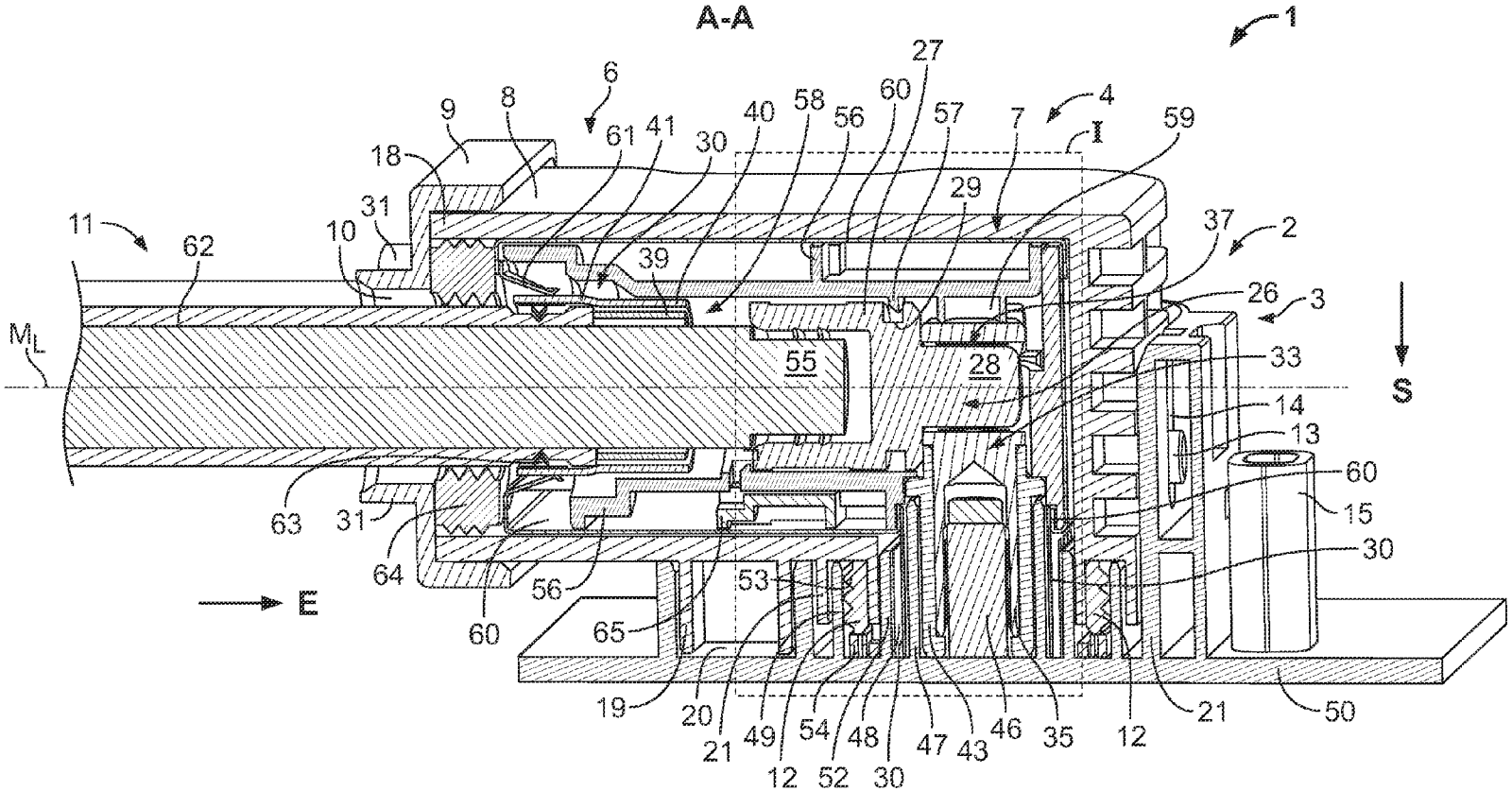
FIG. 6 shows a perspective sectional view of a plug element according to the invention fitted together with a mating plug element along the section line A-A in FIG. 3.

FIG. 6 shows a plug-and-socket connector 1 according to the invention in a diagrammatic perspective sectional view along the section line A-A in FIG. 3, the section line A-A at the same time being a central axis $M_L$ of the electrical conductor 11. The plug-and-socket connector 1 is in the final assembly position F. The plug element 2 is inserted and latched in the mating plug element 3.

The mating contact element 46 is held and electrically contacted in the insertion member 35 of the contact element 33. The contact-element holder 43 of the plug element 2 is introduced into the supporting collar 47 of the mating plug element 3 and supported both in and transversely to the direction of insertion S. The screen contact sleeve 30 of the plug element 2 is introduced into the mating screen contact sleeve 48 of the mating plug element 3. The mating screen contact sleeve 48 is in turn held and supported in a mating screen contact sleeve-supporting element 52 formed on the mating plug element 3. The supporting member 19 of the plug element 2 is seated in the supporting receptacle 20 of the plug element 3. The guide element 13 of the plug element 2 is seated in the guide 14 of the mating plug element 3. Strips 53 of the sealing element 12 are pressed against the mating sealing element 49 transversely to the direction of insertion S. The sealing element 12 is supported on the mating plug element 3 on a seal stop 54 in the direction of insertion S.

Furthermore, it can be seen in the representation selected in FIG. 6 that the contact section 28 of the conductor end piece 26 formed as a pin contact is inserted into the pin receptacle 37 of the contact element 33 in the direction of introduction E. Thus a stripped free end 55 of the electrical conductor 11 attached in the conductor receptacle 27 of the conductor end piece 26 is connected in electrically conductive manner to the mating contact element 46 via the conductor end piece 26 and the contact element 33.

A conductor latching element 57 is formed on an assembly insert 56 arranged in the housing body 7, engages in the latching member 29 on the conductor end piece 26 and locks the conductor end piece 26, which secures the latter against movements counter to the direction of introduction E. A conductor receptacle space 58 is formed in the assembly insert 56 in the interior of the housing body 7. The free end 55 or the end section of the electrical conductor 11 including the conductor end piece 26 and the screen contact sleeve 30 is arranged in the conductor receptacle space. The screen contact sleeve 30 is supported on a wall of the assembly insert 56 transversely to the direction of introduction E.

A supporting element 59 is formed on the assembly insert 56 for supporting the contact element 33 counter to the direction of insertion S. The supporting element 59 is flush with the insertion member 35 of the contact element 33 in the direction of insertion S, and absorbs insertion forces acting on the contact element 33 counter to the direction of insertion S.

A housing screen element 60 is arranged in the housing body 7, which element surrounds the conductor receptacle space 58 and is connected in electrically conductive manner to the screen contact sleeve 30 of the plug section 4. On the housing screen element 60 there is formed a screen contact element 61 which projects into the conductor receptacle space 58 transversely to the direction of introduction E, exerts a spring force on the screen contact sleeve 30 surrounding the electrical conductor 11 and thus contacts the latter in electrically conductive manner. The screen contact sleeve 30 contacts the conductor screen 39 and surrounds it with its screen contact section 40. The conductor screen 39 is embedded in an insulating layer 62 of the electrical conductor 11. The insulating layer 62 is secured in non-is positive manner in the screen contact sleeve 30 with the aid of an insulation clamping ring 63 formed on the inner periphery of the insulation receptacle section 41 surrounding it.

A conductor-sealing element 64 arranged close to the conductor entry opening 10 in the housing body 7 between two opposing sections of the outer wall 18 of the housing body 7 encompasses the outer periphery of the insulating layer 62 of the electrical conductor 11 and seals the latter off from the plug element 2.

Further, a short-circuit means 65 is arranged in the housing body 7. The short-circuit means 65 short-circuits the two electrical conductors 11 as long as they are not in electrical contact with the mating contact element associated therewith in each case or the plug-and-socket connector 1 is not in the final assembly position F.

Figure 7:
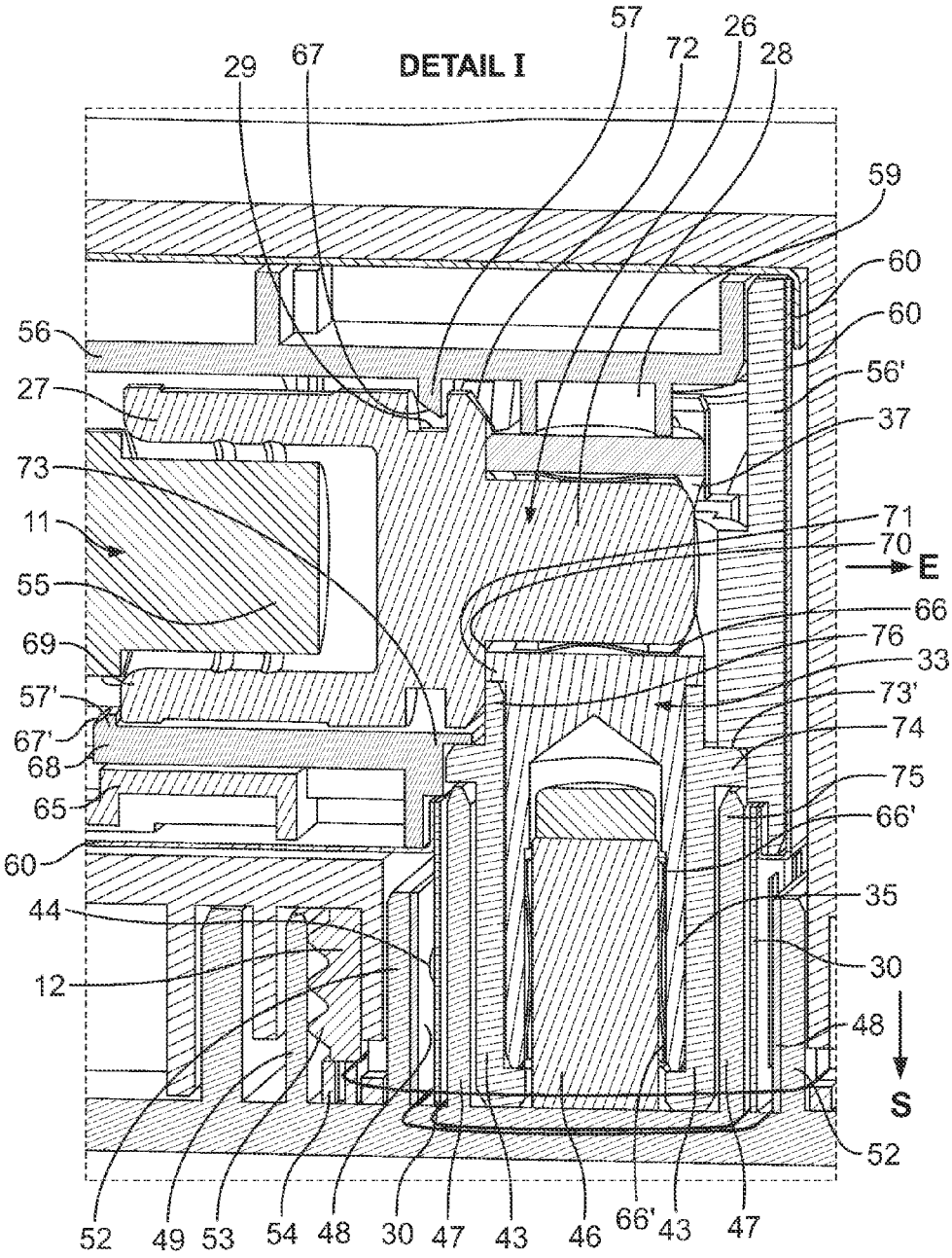
FIG. 7 shows a detail I of the plug element of FIG. 6 when brought together with the mating plug element.

FIG. 7 shows a detail I of the diagrammatic perspective sectional view of the plug-and-socket connector 1 of FIG. 6. Here it is shown in particular that a spring sleeve 66 is inserted into the pin receptacle 37 of the contact element 33 and exerts a spring force on the contact section 28 of the conductor end piece 26 transversely to the direction of introduction E of the electrical conductor 11. A further spring sleeve 66' is inserted into the cylindrical insertion member 35 of the contact element 33, encompasses the mating contact element 46 and exerts a spring force running transversely to the direction of insertion S on the mating contact element 46. Thus the contact section 28 of the electrical conductor 11 and the mating contact element 46 are each held tightly and at the same time flexibly in the pin receptacle 37 and the insertion member 35 respectively. The spring sleeve 66 and further spring sleeve 66' help to compensate for vibrational forces acting between the contact section 28 and the pin receptacle 37 and also between the insertion member 35 and the mating contact element 46 and to ensure uninterrupted electrical contacting at insertion points formed in each case.

Furthermore, it is clearly shown in FIG. 7 that the conductor latching element 57 seated in the latching member 29 of the conductor end piece 26 is formed as a latch projection with a sloping approach surface 67 pointing counter to the direction of introduction E. A further conductor latching element 57' is provided with a further sloping approach surface 67' pointing in the direction of introduction E and formed on a continuation 68 of the assembly insert 56 pointing counter to the direction of introduction E. The further latching element 57' lies counter to the direction of introduction E against an edge region 69 of the conductor end piece pointing counter to the direction of introduction E, and in addition to the conductor latching element 57 prevents movements of the conductor end piece 26 counter to the direction of introduction E.

Between the pin-shaped contact section 28 of the conductor end piece 26 and the conductor receptacle 27 of the conductor end piece 26 there is formed on the conductor end piece 26 a shoulder 70 which in the direction of insertion E lies against a stop 71 formed on the contact element 33 and pointing in the direction of introduction E. The conductor end piece 26 is secured in the direction of introduction E between the stop 71 and the conductor latching elements 57.

A chamfer 72 formed on the shoulder 70 of the conductor end piece 26 and pointing in the direction of introduction E facilitates introduction of the conductor end piece 26 into the securing position. The chamfer 72, upon running on to the sloping approach surfaces 67, 67' of the conductor latching elements 57, 57', presses the conductor latching elements 57, 57' away transversely to the direction of introduction E. Once the conductor latching elements 57, 57' have traversed the chamfer 72 upon insertion, they slide along an outer periphery of the conductor end piece 26 until, on reaching the conductor latching member 29 or the edge region 69 of the conductor end piece 26, they shoot into their starting position transversely to the direction of introduction E, which means that the electrical conductor 11 is in a fastening position $B_L$ of the electrical conductor 11 by latching.

Furthermore, it can be inferred from FIG. 7 that the assembly insert 56 cooperates with a further assembly insert 56'. An insertion stop 73 or a further insertion stop 73' is formed in each case on the assembly insert 56 and the further assembly insert 56', against which stops an annular collar 74 of the contact-element holder 43 lies counter to the direction of insertion S. In the direction of insertion S, the annular collar 74 lies against an edge 75 of the supporting collar 47 formed on the mating plug element 3. Thus the contact-element holder 43 is secured between the insertion stops 73, 73' of the assembly inserts 56, 56' and the edge of the supporting collar 75 in the direction of insertion S.

An edge 76 of the contact-element holder 43 points counter to the direction of insertion S. The stop 71 of the contact element 33 lies against the edge 76. Thus the contact element 33 is secured in the direction of insertion S between the supporting element 59 on the is assembly insert 56 and the upper edge 56 of the contact-element holder 43.

In the context of the inventive concept, deviations from the embodiments described above are possible. For example, the plug element 2 and the mating plug element 3 may be provided in any desired manner with interlocking plug sections 4 and plug receptacles 5. Accordingly, the plug receptacle 5 may also be formed on the plug element 2 and the mating plug element 3 may so to speak be designed to be insertable into the plug element 2. The receiving space 58 in the conductor receptacle section 6 of the plug element 2 may be designed corresponding to the respective requirements and the conductor receptacle section 6 does not inevitably have to run at right-angles or at an angle of approximately 90° to the plug section 4 of the plug element 2, but may also assume other angles. Consequently, the angle between the direction of introduction E and the direction of insertion S may be selected corresponding to the respective requirements.

The housing body 7 can be composed of any desired number of casing elements 8 and closure pieces 9. The housing elements 8, 9 do not inevitably have to be latched together, but may also be connected together positively, non-positively and/or by a material connection by screwing, riveting and/or welding. It is advantageous to keep the number of components forming the housing body 7 as low as possible, in order to use as few seals 64 as possible. In particular, with the embodiments described above it is advantageous for the sealing element 64 to be able to seal off both the electrical conductor 11 from the housing body 7 and the closure piece 9 from the housing body 7. Thus the sealing element 64, as a dual sealing element, fulfils an at least double sealing function.

Further, a sealing element 49 or a seal stop 54 may also be arranged or formed between the conductor-sealing element 64 and the respective sealing faces on the electrical conductor 11 and/or closure piece 9 or housing body 7. The seal stop 54 may be designed as a mating sealing element, which similarly to the sealing element 12 and the conductor-sealing element 64 may be made from flexible alkali-resistant and acid-resistant sealing material.

Furthermore, the housing body 7, the casing element 8, the closure piece 9, the mating plug element 3 and the supporting member 19 may be provided with any desired number of guide elements 13, guides 14, latch tabs 15, latch projection 16 and/or latch openings 17, in order to guarantee, corresponding to the respective requirements, secure seating of the closure piece 9 on the casing element 7 and also of the plug element 2 on the mating plug element 3.

The conductor end piece 26 may, but does not inevitably have to, be designed to be rotationally symmetrical about the central axis $M_L$ of the electrical conductor 11. The conductor end piece 26 may be provided with a number of latching members 29 which fulfils the respective requirements, which members may be designed corresponding to the respective requirements, in order to cooperate with conductor latching elements 57, 57'. The conductor latching elements 57, 57' may, in accordance with the respective requirements, be arranged on the housing body 7 and/or the assembly inserts 56, 56', but in order to guarantee tightness of the plug-and-socket connector should be located in the interior or in the conductor receptacle space 58 of the plug element 2. The assembly inserts 56, 56' can be designed corresponding to the respective requirements and may form supporting elements 59, insertion stops 73, 73' and continuations 68 which in turn may be provided with sloping approach surfaces 67, 67' in order to latch or secure the electrical conductor or conductors 11 securely.

The contact section 28 of the conductor end piece 26 and the conductor fastening section 36 of the contact element 33 and also the insertion member 35 of the contact element 33 and the mating contact element 46 may be designed matched to each other corresponding to the respective requirements as pin or socket contacts. Likewise, the screen contact sleeve 30 and the mating screen contact sleeve 48 may be designed corresponding to the respective requirements to be insertable into each other in any desired manner and to be provided with screen sleeve spring elements 44.

The connection face 32 and the mating connection face 45 may be matched to each other corresponding to the respective requirements with collars 31, supporting collars 47, mating screen contact sleeve-supporting elements 50 and seal stops 54. The contact-element holder 43 and the supporting collar 47 may be designed to be insertable into one another corresponding to the respective requirements and be provided with cooperating ring collars 74, edges 75 and edges 76. It is in particular advantageous if the annular collar 74 of the supporting element 73 fulfils a dual function and supports the assembly inserts 56, 56' both in the direction of introduction E and in the direction of insertion S and at the same time serves as a stop for the upper edge of the supporting collar 74. Likewise advantageous is the dual function of the stop 71 on the contact element 33, on which the conductor end piece 26 is supported in the direction of introduction E and simultaneously the contact-element holder 43 counter to the direction of insertion S.

Further, the housing screen element 60 may comprise a further housing screen element 60', the housing screen elements 60, 60' and also the screen contact sleeve 30 and the screen contact section 40 possibly being designed to be able to be fitted together. Screen elements may in each case be provided with screen contact elements 61 formed corresponding to the respective requirements and advantageously form in each case overlapping regions on their connection or insertion points, so that complete shielding of the electrical conductors 11 is ensured.

Finally, the assembly plate 50 may be provided with any desired number of assembly aids 51 corresponding to the respective requirements. The assembly plate 50 may be a wall section of a battery and/or converter housing.

The invention claimed is:

1. A plug element for a sealed high-voltage plug-and-socket connector, by means of which, in particular in an automobile, an electrical conductor can be connected in an electrically conductive manner to a mating contact element of a mating plug element, comprising:

a housing body having a plug section, which can be fitted together with the mating plug element in a direction of insertion, and a conductor receptacle section remote from the plug section with at least one conductor entry opening, and at least one contact element, which has an insertion member which is spaced apart from the at least one conductor entry opening in the plug section and can be fitted together with the mating contact element, and a conductor fastening section for connecting the at least one electrical conductor, wherein the conductor fastening section is designed as a pin receptacle which is aligned with the at least one conductor entry opening in a direction of introduction for the at least one electrical conductor, and a spring sleeve is arranged in the pin receptacle, wherein the spring force of the spring sleeve acts transversely to the direction of introduction, and a conductor latching element of the housing body extends in a direction transverse to the at least one conductor entry opening.

2. A plug element according to claim 1, wherein the direction of insertion extends approximately at right-angles to the direction of introduction.

3. A plug element according to claim 1, wherein the housing body comprises a closure piece in which the at least one conductor entry opening is arranged and which is fitted together with a casing element of the housing body in the direction of introduction.

4. A plug element according to claim 1, wherein in the housing body a screen contact element projects transversely to the direction of introduction into a conductor receptacle space extending along the direction of introduction.

5. A modular system for a plug element of a sealed high-voltage plug-and-socket connector, by means of which at least one electrical conductor can be connected in an electrically conductive manner to a mating contact element of a mating plug element of the high-voltage plug-and-socket connector, comprising:

a housing body having a conductor latching element;

at least one contact element which can be inserted in the housing body and having an insertion member, which can be fitted together with the mating contact element, and a conductor fastening section for connecting the electrical conductor, wherein the conductor fastening section is designed as a plug contact; and a conductor end piece which is a conductor end piece which is configured to be received within the plug contact and is configured to receive a free end of the electrical conductor, the conductor end piece is configured to be arranged in the housing body and is provided with a latching member which cooperates with the conductor latching element.

6. A method for the assembly of an electrical plug element, in particular for a sealed high-voltage plug-and-socket connector in an automobile, with at least one contact element for contacting a mating contact element of a mating plug element of the high-voltage plug-and-socket connector, comprising the steps of:

preassembling a housing body of the plug element from a plurality of housing elements, the housing body having a conductor receptacle section with at least one conductor entry opening;

aligning a pin receptacle with the at least one conductor entry opening in a direction of introduction;

arranging a spring sleeve within the pin receptacle;

inserting at least one conductor into the at least one conductor entry opening in the housing body after preassembling the housing body, advancing the at least one conductor through the housing to contact the spring sleeve such that a spring force of the spring sleeve acts transversely to the direction of introduction; and latching and simultaneously connecting in an electrically conductive manner the at least one conductor to the at least one contact element.

* * * * *